US006386204B1

(12) United States Patent
Kontos

(10) Patent No.: US 6,386,204 B1
(45) Date of Patent: May 14, 2002

(54) CIGAR HOLDER WITH CUTTER

(76) Inventor: George Vlasios Kontos, 3909 Lake Des Allemands Dr., Harvey, LA (US) 70058

( * ) Notice: Subject to any disclaimer, the term of this patent is extended or adjusted under 35 U.S.C. 154(b) by 0 days.

(21) Appl. No.: 09/614,172

(22) Filed: Jul. 11, 2000

Related U.S. Application Data

(63) Continuation-in-part of application No. 09/390,743, filed on Sep. 7, 1999, now Pat. No. 6,161,550.

(51) Int. Cl.[7] ..... A24F 13/24; A24C 1/24; A65D 69/00

(52) U.S. Cl. ..... 131/250; 131/188; 131/253; 131/254; 131/248; 131/252; 131/233; 131/255; 30/109; 30/111; 206/238

(58) Field of Search ..... 131/329, 187, 131/188, 253, 254, 248, 250, 252, 233, 255; 30/109, 111, 112, 113; 206/238, 265, 276

(56) References Cited

U.S. PATENT DOCUMENTS 4,907,604 A * 3/1990 Beloff ..... 131/256
5,377,696 A * 1/1995 Goldman ..... 131/248
5,862,809 A * 1/1999 Nicotra ..... 131/256
6,161,550 A * 12/2000 Kontos ..... 131/250

* cited by examiner

*Primary Examiner*—Stanley S. Silverman
*Assistant Examiner*—Dionne A. Walls
(74) *Attorney, Agent, or Firm*—Shawn David Sentilles

(57) ABSTRACT

A cigar holder with a cutter comprising a hollow cigar-shaped body having a closed bottom and an open top, a hollow cap threadably engageable with the top of the body, the cap having a pair of substantially opposing slots therethrough, and a pair of cigar tip cutting members, each cigar tip cutting member having a cutting portion having a cutting edge thereon. Each of the cigar cutting members is slidably positioned in one of the slots such that the cutting edges are positioned substantially opposite one another in the hollow cap. A handle portion is preferably hinged to the cutting portion of each of the cigar tip cutting members, with each handle portion being positioned outside of the cap. The handle portions are preferably provided with a gripping tip for facilitating manual movement of the cigar tip cutting member in relation to the cap. The cap preferably has a pair of recesses formed in an outer wall thereof. A channel forming member is preferably fixedly positioned in the cap for forming a channel in a draw end of a cigar to thereby facilitate flow of smoke through the cigar. The channel forming member preferably comprises a hollow cylindrical member having a sharpened tip. A configuration for a channel forming member that can be retrofit into a pre-manufactured cigar holder is provided.

17 Claims, 2 Drawing Sheets

10
52
12
14
36
42
38
18

52
40
20
26
16
28
36
42
38
22
44
18

14
46
50
48
34
36
42
24
22
58

14
54
30
32
42
24
22
58

22
56

CIGAR HOLDER WITH CUTTER

CROSS REFERENCES TO RELATED APPLICATIONS

This application is a CIP of U.S. patent application Ser. No. 09/390,743, which was filed in the United States Patent and Trademark Office on Sep. 7, 1999 and is now U.S. Pat. No. 6,161,550.

FIELD OF INVENTION

This invention relates to a cigar holder, and more particularly to cigar container equipped with a means for cutting a cigar tip.

BACKGROUND OF THE INVENTION

In recent years, cigar use has increased dramatically in comparison with even 10 years before. Both men and women and people of different ages engage in this past time. Cigar aficionados can be found almost anywhere in the world.

Some of the best cigars are conventionally sold in wooden boxes, with each cigar individually wrapped in cellophane to retain moisture and freshness of the cigar. Very high quality cigars are sold individually encased in a cigar-shaped container, where they are protected from the environment until ready for use by the consumer.

Cigar smokers usually test the freshness of the cigar by rolling it between the fingers to make sure that the cigar is pliable and therefore in top condition for smoking. If the cigar is of the quality desired by the consumer, he/she cuts off one tip of the cigar to make the cut end of the cigar more penetrable to smoke inhaled by the user.

Various devices have been devised for cutting the tip of the cigar. These devices may be in the shape of a knife, scissors, etc. The goal is to prevent fraying of the cut end of the cigar, which would make the cigar legg convenient for holding in the smoker's mouth.

Some of the known devices incorporate the cigar cutter directly into an individual cigar container. Most of the prior cigar cutter/container devices have been designed for use with non-portable containers.

One such device is disclosed in U.S. Pat. No. 61,234 issued on Jan. 15, 1867 to Myers et al. There, two portions of a cigar tube are held by a spring in a telescopic relationship. When the two portions are held in a spaced apart relationship to each other, a cigar end is extended through an orifice, where it is cut by a knife incorporated in the device.

Another example is shown in U.S. Pat. No. 486,004 issued on Nov. 8, 1892 to Ullin where semicircular portions of a cigar case are hinged together along one side. A plurality of knives or cutters is provided inside the cigar case. When the portions of the case are closed, the knives sever the burnt end of the cigar leaving the remainder of the cigar intact.

Still another example is shown in U.S. Pat. No. 1,025,484 issued on May 7, 1912 to Schwieger, where a cigar cutter is built into a case. The cutting knife in that patent is a slotted lever positioned near the tongue engaged in the slot. The lever has a catch that engages the lid of the case. The lever slides pivotally to cut an end of the cigar.

U.S. Pat. No. 1,598,111 issued on Aug. 31, 1926 to Bauda discloses a cigar holder with a cutter formed as a knife gauge. The knife is pivoted to one end of the cigar holder section, with the other end having a handle that forms a spring clip.

Several patents were issued for using a cigar cutter built into a holder for cutting off a used portion of the cigar and retaining the unsmoked portion of the cigar in the case for future use. Such devices are shown in, for example, U.S. Pat. No. 2,664,091 issued on Dec. 29, 1953 to Thorstenson and U.S. Pat. No. 4,907,604 issued on Mar. 13, 1990 to Beloff. U.S. Pat. No. 4,907,604 discloses a cigar holder having a pin on an inside of a cap thereof for punching a hole in a cigar tip. German Patent No. 503,638 issued on Mar. 27, 1929 to Schneider discloses a cigar cutterbuilt into a cigar case.

While this list is not exhaustive, it illustrates the developments in the field of cigar holders or cases that are combined with a cigar cutter that eliminates the need for carrying a special clipper or knife in one's pocket to cut the end of a cigar.

While these devices work in a satisfactory manner under certain conditions, there exists a need for a portable cigar holder or case with a built-in cigar cutter that is easy to use and inexpensive to manufacture.

OBJECTS AND SUMMARY OF THE INVENTION

It is, therefore, an object of the present invention to provide a portable cigar holder with a pair of built-in cigar cutters.

It is another object of the present invention to provide a cigar holder with a pair of cigar cutting members that are built into a cap of a cigar holder.

It is a further object of the present invention to provide a cigar holder with a plug remover for extracting a plug from a draw end of a cigar so as to improve smoke penetration through the cigar.

It is yet another object of the present invention to provide a plug removing device which can be inserted into the cap of existing cigar holders.

These and other objects and advantages of the invention shall become apparent from the following general and preferred description of the invention.

Accordingly, a cigar holder with a cutter is provided comprising a hollow cigar-shaped body having a closed bottom and an open top, a hollow cap threadably engageable with the top of the body, the cap having a pair of substantially opposing slots therethrough, and a pair of cigar tip cutting members, each cigar tip cutting member having a cutting portion having a cutting edge thereon. Each of the cigar cutting members is slidably positioned in one of the slots such that the cutting edges are positioned substantially opposite one another in the hollow cap. A handle portion is preferably hinged to the cutting portion of each of the cigar tip cutting members, with each handle portion being positioned outside of the cap. The handle portion of each of the cigar tip cutting members is preferably provided with a gripping tip for facilitating manual movement of the cigar tip cutting member in relation to the cap. The cap preferably has a pair of recesses formed in an outer wall thereof, each of the recess sized and positioned such that the handle portion of one of the cutting members may be selectively fitted substantially entirely within the recess. A channel forming member is preferably fixedly positioned in the cap for forming a channel in a draw end of a cigar to thereby facilitate flow of smoke through the cigar. The channel forming member preferably comprises a hollow cylindrical member having a sharpened tip.

In one embodiment, the channel forming device can be inserted into a conventional cigar holder. The channel forming device comprises a base member having a support side and a channel forming side, and a channel forming member fixedly positioned on and projecting substantially perpendicularly from the channel forming side of the base member. The base member is sized to permit insertion of the base member into the cigar holder. The support side of the base member is configured such that when the support side is abutted against the closed end of the cigar holder, the base member maintains the channel forming member in substantially parallel alignment with a longitudinal axis of the cigar holder. The channel forming member is preferably substantially centrally disposed on the base member. The channel forming member preferably has a sharpened end to facilitate formation of the channel in the draw end of the cigar. The channel forming member preferably has an opening extending longitudinally therethrough, the opening facilitating formation of the channel and removal of a plug of tobacco from the tip of the cigar. Outer edges of the base member are preferably sized to abut against the interior wall of the cigar holder. The base member preferably has a substantially flattened profile. The base member preferably comprises an outer annular member having a plurality of spoke members centrally disposed therein. The base member is preferably composed of a semi-rigid flexible material to facilitate insertion and placement of the channel forming device in the cigar holder.

PREFERRED EMBODIMENTS OF THE INVENTION

Figures 1, 2, 3, 4, 5:
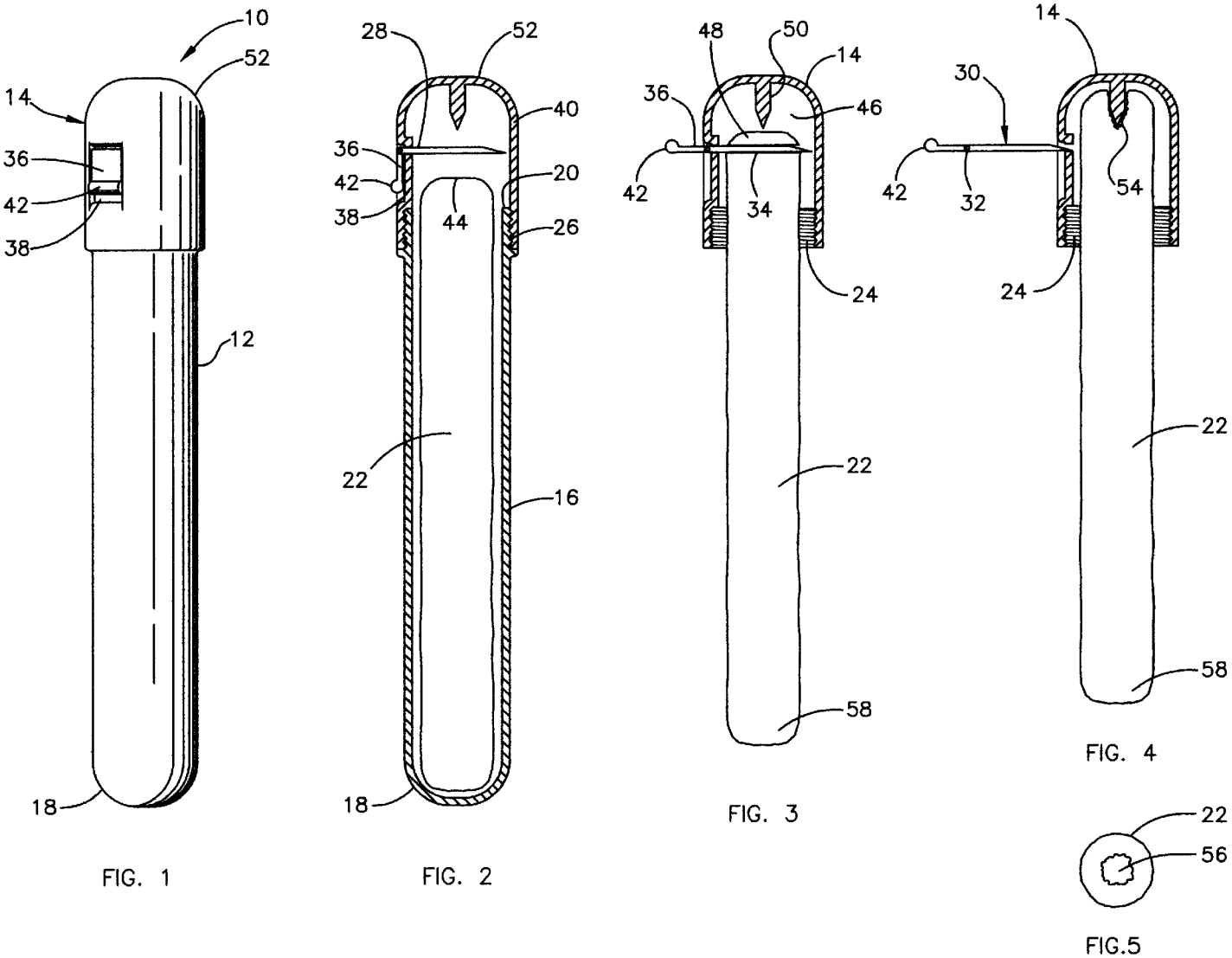
FIG. 1 is a perspective side view of one preferred embodiment of a cigar holder according to the invention.
FIG. 2 is a cross-sectional side view of one preferred embodiment of the cigar holder of the invention, showing a pair of cutting knives stored in the cigar holder.
FIG. 3 is a cross-sectional side view of one preferred embodiment of the cigar holder of the invention, showing the cutter knives cutting the tip of a cigar.
FIG. 4 is a cross-sectional side view of one preferred embodiment of the cigar holder of the invention, showing the channel forming member penetrating one end of the cigar.
FIG. 5 is a top view of a draw end of a cigar showing a smoke channel formed in the cigar end by the channel forming member of the invention.

Turning now to the drawings in more detail, numeral 10 designates the cigar holder in accordance with the invention. The holder or container 10 comprises a main body 12 and a cap 14 of a size and shape to accommodate an individual cigar. It is preferred that the holder 10 be relatively slim so as to comfortably fit in a coat pocket or purse of the user, although the nature of the present invention does not depend on the particular size of the cigar holder 10.

As shown in FIG. 2, the main body 12 is a generally cylindrically shaped hollow body having a cylindrical wall 16 and a rounded closed bottom 18. The top edge 20 of the hollow body 12 defines an open top through which a cigar 22 extends.

The cap 14 is provided with internal threads 24, as can be better seen in FIGS. 3 and 4, formed adjacent the lower part of the cap 14. The threads 24 are adapted to engage mating threads 26 formed on the exterior portion of the hollow body 12, as can be seen in FIG. 3. When the cap 14 is engaged with the main body 12, the cap 14 prevents the cigar 22 from falling out through the open end of the body 12.

A narrow slot or opening 28A is formed on the cap 14 transversely to a longitudinal axis thereof. A second narrow slot or opening 28B is formed on the cap 14 transversely to a longitudinal axis thereof The first and second slots 28A, 28B are preferably positioned on opposite sides of the cap 14. Fitted within each of the slots 28A, 28B is a cigar cutting member or knife 30A, 30B. Each cigar cutting member or knife 30A, 30B is composed of two sections joined by a hinge 32A, 32B. A sharpened first cutting portion 34A, 34B of each cutting member 30A, 30B extends inside the cap 14 transversely to the longitudinal axis of the cap 14 in a manner shown in FIG. 2.

Hinged to each first portion 34A, 34B is a second handle portion 36A, 36B. The second portion 36A, 36B normally extends at a right angle to the first portion 34A, 34B and lies flat inside a recess 38A, 38B formed in the exterior wall 40 of the cap 14. When the cap 14 is secured to the main body 12, the second portion 36A, 36B is oriented in a general alignment to the exterior wall 40 of the cap 14.

A gripping tip 42A, 42B is preferably formed on a lower part of each second portion 36A, 36B. The gripping tip 42A, 42B allows a user to grasp the tip 42A, 42B by fingers or nails and move the second handle portion 36A, 36B upwardly against its respective hinge 32A, 32B and align the second handle portion 36A, 36B with its respective first cutting portion 34A, 34B, as can be seen most clearly in FIG. 3.

Generally the cap 14 is of sufficient size to extend above the draw end 44 of the cigar 22, such that the cutting portion 34 of the cutting member 30 does not interfere with the cigar 22 and does not fray or damage the end of the cigar 44. When the cigar tip 48 needs to be cut, the cap 14 is disengaged from the body 12. The cap 14 is then held in one hand of the user. The user then lifts the second handle portions 36A, 36B of each cutting member 30A, 30B to form a pair of straight cutting members 30. The hinges 32A, 32B are locked to prevent return of the second portion 36A, 36B to its perpendicular position in relation to the first portion 34.

The user then pulls each cutting member 30A, 30B partially from the cap 14 and extends the cigar 22 into the hollow chamber 46 formed by the cap 14. The cigar 22 is preferably extended to align the end of the cigar across from the slot 38 in the cap 14.

Each cutting member 30 is then pushed inside the cap 14, cutting off a tip 48 of the cigar 22. The cigar 22 is then withdrawn from the cap 14, the tip 48 is disposed of, and the cutting members 30A, 30B are returned to their normal position, with the first cutting member 34A, 34B inside the cap in a manner similar to the position shown in FIG. 2. For each new cigar 22 is placed in the holder 10, the process of cutting the tip 48 of the cigar 22 can be repeated as needed.

Some cigar smokers make a puncture through the draw end of the tip 48 of the cigar 22 in order to decrease the smoke penetrating surface and enhance the permeability of the cigar 22 to smoke drawn through the cigar 22 to the mouth of the user. It is believed that the puncture forms a channel through which the smoke has a better ability to permeate and reach the unlit draw end of the cigar during smoking.

To this end, various pins or stilettos have been used to puncture the top end 44 of the cigar 22. Some of the known cigar holders are provided with a built-in puncture pin that extends from the interior of the cigar holder. However, a simple puncture, as a general rule, creates only a very small opening that oftentimes closes under the inherent elastic forces in the rolled tobacco leaves that form the body of the cigar.

The present invention overcomes this shortcoming by providing, in a preferred embodiment, a channel/plug removing member 50 fixedly attached to the inner top wall 52 of the cap 14. The channel forming member 50 is a cylindrical tube (preferably hollow) that can be cut straight or at an angle to form a sharpened point 54, as shown in the drawings, or as a straight sharp edge (not shown). When the user wishes to create an opening or channel inside the top portion 44 of the cigar 22, the user disengages the cap 14 from the main body 12, withdraws the cutting portion 34A, 34B of each cutting members 30A, 30B from its respective slot 28A, 28B, and moves the top or draw end 44 of the cigar 22 into the chamber 46 of the cap 14. By pushing the cigar 22 all the way inside the cap 14, the user is able to force the channel forming member 50 into the end 44 of the cigar 22.

As shown in FIG. 5, when the cigar 22 is withdrawn from the cap 14, a distinct opening or smoke channel 56 is formed in the draw end 44 of the cigar 22. The opening 56 often has uneven edges but is wide enough not to close under the elasticity of the tobacco leaves that form the body of the cigar 22.

The small plug of tobacco leaves that is retrieved by the member 50 is shaken off from the cap 14, and the cutting members 30A, 30B are returned to their normal position inside the cap 14 for future use. The hole 56 formed by the channel forming member 50 facilitates a flow of smoke from the lit end 58 of the cigar 22 and delivery of that flow of smoke to the draw end 44 of the cigar 22.

If desired, the main body 12 can be formed as a packet of individual holders secured together by molding or by welding, each cylindrical section being formed to accommodate an individual cigar. The cutting members 30A, 30B in such a case may be incorporated into a side of a cap 14 and several cigars can be cut using the same pair of cutting members 30A, 30B. Alternatively, cutting members 30A, 30B may be provided in every cap.

The holder 10 is preferably made from a lightweight material to facilitate portability of the holder. Similarly, the channel forming member 50 can be made from the same material as the cap 14 and can be molded together with the cap 14 or fixedly attached, such as by welding or a glue to the inside of the cap 14, in a general center thereof to extend in co-alignment with the longitudinal axis of the cap 14.

Figure 7:
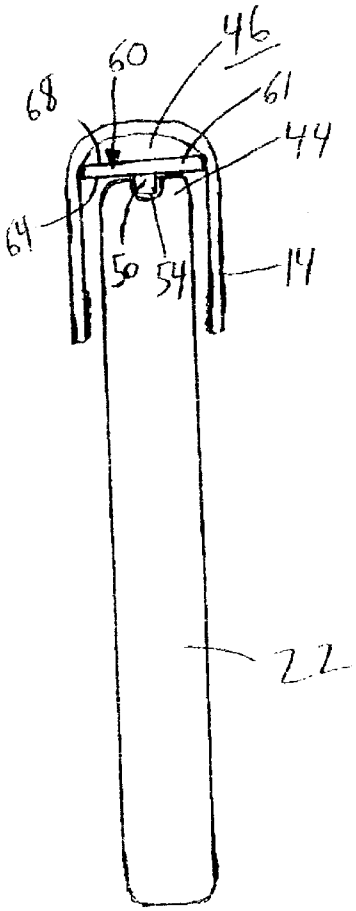
FIG. 7 is a side view of the removable channel forming member of FIG. 6, showing the removable channel forming member positioned in a cap of a cigar holder.
Figure 6:
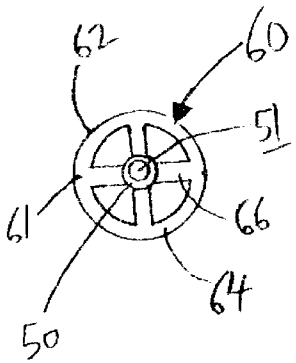
FIG. 6 is a top view of a removable channel forming member that can be positioned in a cigar holder.

The embodiment shown in FIGS. 6 and 7 is a plug/channel forming device 60 that can be retrofit into a cigar holder 10. The channel forming member 60 is preferably fitted into the chamber 46 of the cap 14 of existing cigar holders 10. Alternatively, the plug forming device 60 can be inserted into the closed bottom 18 of the main body 12 of the cigar holder 10. The channel forming device 60 is preferably constructed of inexpensive metal or plastic. The channel forming member 60 may be molded using conventional molding techniques.

The channel forming device 60 comprises a channel forming member 50 fixedly positioned on abase member 61. The channel forming device 60 is preferably substantially centrally disposed on the base member 61. The channel forming device 60 projects substantially perpendicularly from a channel forming side 64 of the base member 61, so as to provide proper alignment of the channel forming device 60 with the longitudinal axis of the cigar holder 10, as described in further detail below. As shown in FIG. 6, the channel forming member 50 is preferably provided with an opening 51 extending longitudinally therethrough. A cutting end 54 of the channel forming member 50 is sharpened so as to facilitate puncture of the tip 48 of the draw end 44 of a cigar 22, in the manner described above with regard to the fixedly positioned channel forming member. The channel forming member 50 is fixedly attached to a channel forming side or surface 64 of the base member 61. The opposite side of the base member 61 is a support side or surface 68 that is preferably configured such that when the support side 68 is abutted against the closed end of the cigar holder 10, the base member 61 maintains the channel forming member 50 in substantially parallel alignment with a longitudinal axis of the cigar holder 10. The base member 61 preferably maintains the channel forming member 50 in axial alignment with the central longitudinal axis of the cigar holder 10. For most applications, the support side 68 is flat, or of substantially flattened profile, so as to provide a uniform support surface. Alternatively, for use with domed caps 14, the support side 68 may be domed or otherwise configured to provide solid contact with the inside top surface of the cap 14.

The base member 61 can be of various shapes and configurations, provided that an outer edge or edges 62 of the base member 61 provides a means for engaging the inner surface of the cap 14 and thereby holding the channel forming member 50 in a desired position in the cap 14. FIG. 6 shows a circular or annular base member 61 comprising a plurality of spoke members 66 centrally disposed within an annular member. The spoke embodiment is particularly useful with caps 14 of conventional cigar holders, which are typically provided with a small piece of cork, often wafer shaped, that is positioned at the top of the cap 14 to absorb moisture. The spoke embodiment 61 of the base member maximizes the amount of cork that remains uncovered, thus avoiding inhibition of moisture absorption by the cork.

The base member 61 is sized to permit insertion of the base member into the cigar holder. The base member 61 is preferably sized such that the outer edge 62 abuts tightly against the inner surface of the cap 14. As shown most clearly in FIG. 7, when using a cap 14 having a rounded top or domed configuration, the rounded top of the cap 14 provides a stop position beyond which support side 68 of the channel forming device 60 cannot be pushed, even when a cigar 22 is pushed onto the channel forming member 50. Although the channel forming device 60 is designed primarily for use in a cap 14 of a cigar holder 10, the device may also be used in the closed bottom 18 of the main body 12 of a cigar holder 10.

The plug forming device 60 is designed primarily for insertion into cigar holders 10 at the point of manufacture of the cigar holders 10. The circumference of the base member 61 is preferably equal to or slightly larger than the circumference of the inner wall of the cap 14 or body 12, such that the plug forming device 60 is held in place by pressure between the outer edge 62 of the base member 61 and the inner wall of the cap 14 or body 12 of the cigar holder 10. To facilitate insertion and placement of the plug forming device 60 in the tube, the plug forming device 60 can be constructed from a bendable or semi-rigid material, such as plastic. In this embodiment, the base member 61 can be pinched and inserted into the tube 10 at an angle. Once the plug forming device 60 has been pushed in place, it resumes its original shape such that the outer edge 62 of the base member 61 contacts the inner wall of the cap 14 or body 12, thereby creating sufficient pressure to maintain the plug forming device 60 in position during use. Additionally, an adhesive can be applied to secure the base 61 of the plug forming device 60 to the cap 14 or body 12. It is also anticipated that the plug forming device 60 will find use as a retrofit item for cigar holders 10 that are sold without a plug forming device 60. This particular use will be particularly effective for standard size cigar holders 10, where plug forming members 60 can be readily provided of a size sufficient to maintain the plug forming device 60 in place in the cigar holder 10 in the above described manner.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A cigar holder comprising:

a hollow cigar-shaped body having a closed bottom and an open top;

a hollow cap threadably engageable with said top of said body, said cap having a pair of substantially opposing slots therethrough;

a pair of cigar tip cutting members, each said cigar tip cutting member having a cutting portion having a cutting edge thereon; and each of said cigar cutting members slidably positioned in one of said slots such that said cutting edges are positioned substantially opposite one another in said hollow cap.

2. The cigar holder of claim 1, further comprising a handle portion hinged to said cutting portion of each of said cigar tip cutting members, each said handle portion being positioned outside of said cap.

3. The cigar holder of claim 2, wherein said handle portion of each of said cigar tip cutting members is provided with a gripping tip for facilitating manual movement of said cigar tip cutting member in relation to said cap.

4. The cigar holder of claim 2, further comprising said cap having a pair of recesses formed in an outer wall thereof, each said recess sized and positioned such that said handle portion of one of said cutting members may be selectively fitted substantially entirely within said recess.

5. The cigar holder of claim 2, wherein said channel forming member comprises a hollow cylindrical member having a sharpened tip.

6. The cigar holder of claim 1, further comprising a channel forming member fixedly positioned in said cap for forming a channel in a draw end of a cigar to thereby facilitate flow of smoke through said cigar.

7. The cigar holder of claim 6, further comprising a handle portion hinged to said cutting portion of each of said cigar tip cutting members.

8. The cigar holder of claim 7, wherein said handle portion of each of said cigar tip cutting members is provided with a gripping tip for facilitating manual movement of said cigar tip cutting member in relation to said cap.

9. The cigar holder of claim 7, further comprising said cap having a pair of recesses formed in an outer wall thereof, each said recess sized and positioned such that said handle portion of one of said cutting members may be selectively fitted substantially entirely within said recess.

10. The cigar holder of claim 1, further comprising a channel forming device for insertion into said cigar holder for forming a channel in a tip of a draw end of a cigar inserted in said cigar holder, comprising:

a base member having a support side and a channel forming side, a channel forming member fixedly positioned on and projecting substantially perpendicularly from said channel forming side of said base member, said base member sized to permit insertion of said base member into said cigar holder, and said support side of said base member configured such that when said support side is abutted against a closed end of said cigar holder, said base member maintains said channel forming member in substantially parallel alignment with a longitudinal axis of said cigar holder.

11. The device of claim 10, wherein said channel forming member is substantially centrally disposed on said base member.

12. The device of claim 10, wherein said channel forming member has a sharpened end to facilitate formation of the channel in the draw end of the cigar.

13. The device of claim 10, wherein said channel forming member has an opening extending longitudinally therethrough, said opening facilitating formation of the channel and removal of a plug of tobacco from the tip of the cigar.

14. The device of claim 10, wherein outer edges of said base member are sized to abut against the interior wall of said cigar holder.

15. The device of claim 10, wherein said base member has a substantially flattened profile.

16. The device of claim 10, wherein said base member comprises an outer annular member having a plurality of spoke members centrally disposed therein.

17. The device of claim 10, wherein said base member is composed of a semi-rigid flexible material to facilitate insertion and placement of said channel forming device in said cigar holder.

* * * * *